United States Patent [19]

Meyers

[11] 3,991,897

[45] Nov. 16, 1976

[54] CANNING JAR LID AND SEALING SYSTEM

[76] Inventor: Ronald B. Meyers, 1750 Augusta, Eugene, Oreg. 97403

[22] Filed: Oct. 2, 1975

[21] Appl. No.: 618,817

[52] U.S. Cl. ..... 215/230; 215/262; 215/290; 215/364

[51] Int. Cl.[2] ..... B65D 45/04

[58] Field of Search ..... 215/230, 262, 270, 290, 215/364; 220/231, 287

[56] References Cited

UNITED STATES PATENTS

| | | | |
|---|---|---|---|
| 36,131 | 8/1862 | Zettle | 215/290 |
| 602,791 | 4/1898 | Wurzburg | 215/262 |
| 726,321 | 4/1903 | Mason | 215/262 |
| 731,792 | 6/1903 | Kunkel | 215/290 |
| 1,002,963 | 9/1911 | Bostwick | 215/290 |
| 1,331,336 | 2/1920 | Fisher | 215/290 |
| 1,430,169 | 9/1922 | Keeran | 215/262 |
| 2,142,590 | 1/1939 | Smith | 215/262 X |

*Primary Examiner*—Donald F. Norton
*Attorney, Agent, or Firm*—Klarquist, Sparkman, Campbell, Leigh, Hall & Whinston

[57] ABSTRACT

A canning jar sealing system has a reusable flat transparent glass lid with bosses of unequal diameter raised from its opposite sides. A peripheral flange portion of the lid is supported on the upper edge of a jar rim so that one boss extends into the mouth of the jar. A thin, flat, reusable, elastomeric sealing ring snugly encircles such boss and extends between the lid flange and the jar rim to form an airtight seal when a partial vacuum is created within the jar during the canning process. Each boss has one or more broad indentations along its peripheral edge which become filled by the sealing ring to indicate that the jar is sealed when the partial vacuum develops. A removable spring clip grips a bead or threads on the outside of the jar rim and exerts a downward force against the center of the lid to secure it to the rim of the jar until a seal is created by the partial vacuum.

8 Claims, 3 Drawing Figures

CANNING JAR LID AND SEALING SYSTEM

BACKGROUND OF THE INVENTION

1. Field of the Invention

The present invention relates to a canning jar lid and sealing system.

2. Description of the Prior Art

Conventional canning jar sealing systems employ a screw-threaded rim cap with an open center and a thin sealant-coated tin center lid which fits over the mouth of the jar and is secured in place by the screw cap. The conventional sealing system described has several disadvantages. First, the center lid portion is not safely reusable. Second, there are sealing problems because of the film of sealant used and the thin lid which is easily bent. Third, the lid and cap fit only one jar size and thread size and type, thereby requiring a specially made canning jar. A fourth disadvantage is that in recent years a tremendous shortage of canning tops using the conventional system has been created. Fifth, the thin coating on the lid is easily scratched; and if this occurs, oxidation of the lid and contamination of the contents of the jar can result.

Various other types of canning jar sealing systems have been proposed, but they are not as convenient to use nor as reliable as the above-described system and have many of the other disadvantages of the described conventional system.

Accordingly there is a need for a canning jar lid and sealing system which are improvements in the above respects over existing such lids and systems.

SUMMARY OF THE INVENTION

The present invention comprises a three-part reusable sealing assembly including a flat, disc-shaped glass or similarly rigid and preferably transparent lid, a thin, flat, elastic sealing ring which snugly encircles one of two raised bosses centered on the opposite surfaces of the lid to extend between the lid and the top edge of the rim of a jar, and a removable spring clip to temporarily secure the lid to the jar until a partial vacuum created within the jar seals the jar and holds the lid in place. The bosses are of different diameters so that either side of the lid can be placed down over a jar mouth with one of the bosses extending into the mouth to accommodate jar mouths of different sizes. The bosses may be provided with notches along their peripheral edges into which the sealing ring extends when the jar is sealed to serve as a sealing indicator.

A primary object of the present invention is to provide an improved canning jar lid and sealing system which are reusable.

A second primary object is to provide an improved canning jar lid and sealing system which can be used on jars having different mouth sizes and different thread sizes and types.

Another important object is to provide a lid and sealing system as aforesaid which can be used in conjunction with ordinary glass jars of various sizes and shapes which are not specially manufactured for use in canning.

Still another important object is to provide a lid and sealing system as aforesaid with built-in indicia for indicating when the canning jar is sealed.

Another primary object is to provide a lid and sealing system as aforesaid which provides a more effective seal than prior such lids and systems.

Another important object is to provide a lid and sealing system as aforesaid which are easier to use and more reliable than previous such lids and systems.

Another object is to provide a lid and sealing system as aforesaid which is more readily cleansed and less subject to contamination than prior such lids and systems.

The foregoing and other objects, features and advantages of the present invention will become more apparent from the following detailed description which proceeds with reference to the accompanying drawings.

DETAILED DESCRIPTION

Figure 1:
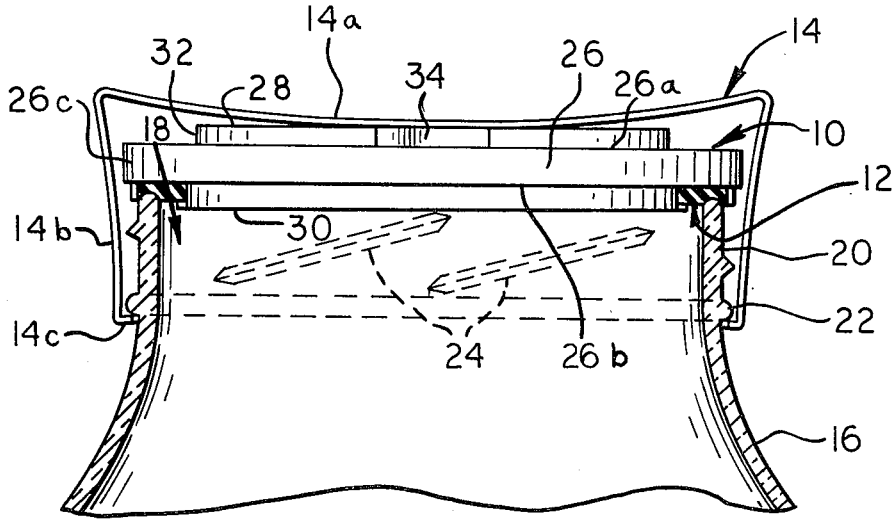
FIG. 1 is an elevational view, partly sectioned, showing a canning jar sealing system in accordance with the invention in use on a jar top.
Figure 2:
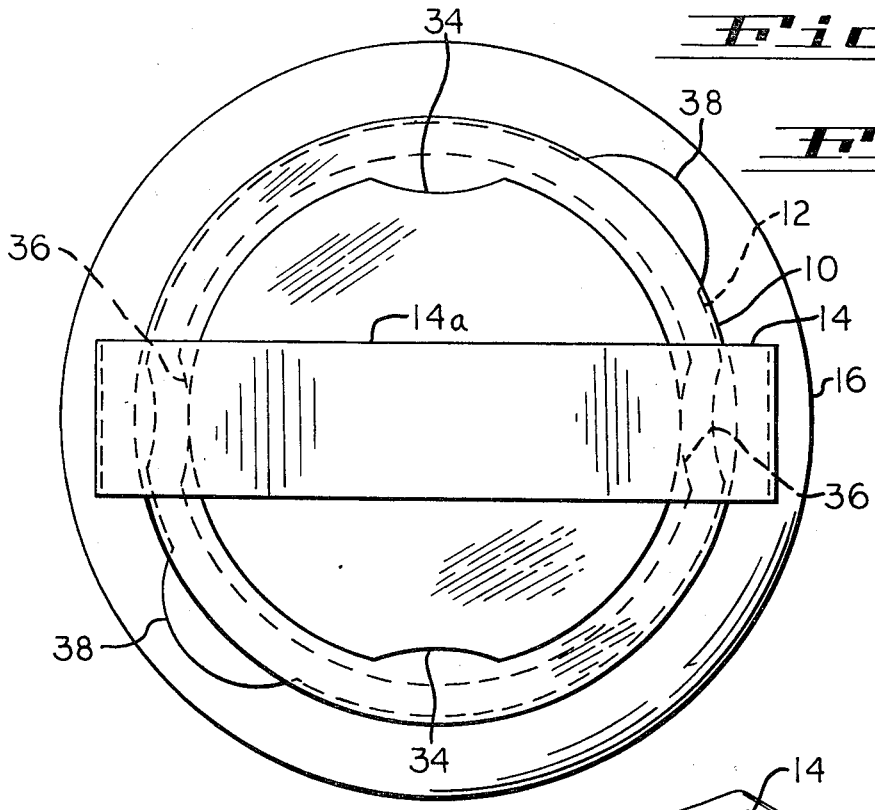
FIG. 2 is a plan view of the sealing system of FIG. 1.

With reference to the drawing, the sealing system comprises three elements, namely, a glass or other rigid lid 10, a resilient rubber or other elastomeric sealing ring 12, and a spring clip 14, all of which are adapted to be assembled together over the mouth of a jar 16 to be used for canning. The jar typically has a mouth 18 defined by a top rim 20 usually provided with an annular bead 22 and threads 24 for screwing a conventional screw top onto the jar.

Lid 10 is flat, rigid and generally disc-shaped and is preferably made of transparent glass. However, it could, if desired, be made of translucent glass or plastic. If the indicator feature of the sealing system is not deemed essential, the lid would need to be made of a light-transmitting material. The lid includes a thin, flat, disc-like main body portion 26 of sufficient diameter to extend over the rim of jars of various mouth diameters to which the lid might be applied, as shown in FIG. 1. The main body portion includes flat upper and lower surfaces 26*a* and 26*b*, respectively.

Each of the opposed lid surfaces has a raised central boss portion 28, 30 spaced inwardly from the periphery of main body portion 26 so as to define a peripheral flange 26*c* adapted to overlie the upper edge of a jar rim 20. The peripheral edge or rim 32 of boss 28 has at least one and preferably two opposed broad concave indentations or indicator notches 34. Boss 30 has similar notches 36, the purpose of which will be explained in detail later, but in general is to serve as a visual indication of when the jar is sealed.

One boss 28 is of smaller diameter than the other boss 30, this being for the purpose of accomodating jars having different mouth sizes. As will be apparent from FIG. 1, as one boss depends downwardly into the mouth of the jar 16, the other boss 28 extends upwardly as the peripheral flange 26*c* of the lid is supported on the upper edge of the jar rim 20. If boss 30 is too large to fit within a particular jar mouth, the lid 10 would simply be turned over so that the smaller boss 28 extends into the mouth.

A thin, flat resilient rubber or other stretchable elastomeric sealing ring 12 encircles snugly whichever one of the two bosses extends downwardly into the jar mouth to form an air seal between lid flange 26*c* and the jar rim when the lid is placed over the mouth. Sealing ring 12 has oppositely disposed tabs 38 which when pulled outwardly break the air seal to facilitate removal of the lid from a sealed jar when desired and also removal of the sealing ring from the lid. The sealing ring has sufficient elasticity so that it can be placed snugly about the periphery of either boss.

The spring clip 14 is made of a spring steel. A suitable material for the spring clip is No. 304 stainless steel having a 22-gauge thickness. The material is formed to the shape shown and then heat-treated after its formation to give it its spring characteristics. The clip includes a relatively wide, thin, band portion 14*a* which extends across the top of the lid. The band portion has downturned opposite end portions forming depending arms 14*b* which extend downwardly along opposite sides of the jar outwardly of the periphery of the lid. These arms terminate in inturned tab portions 14c for gripping either the underside of the bead 22 or the underside of some of the threads 24 of the typical jar 16, whichever is most convenient.

Figure 3:
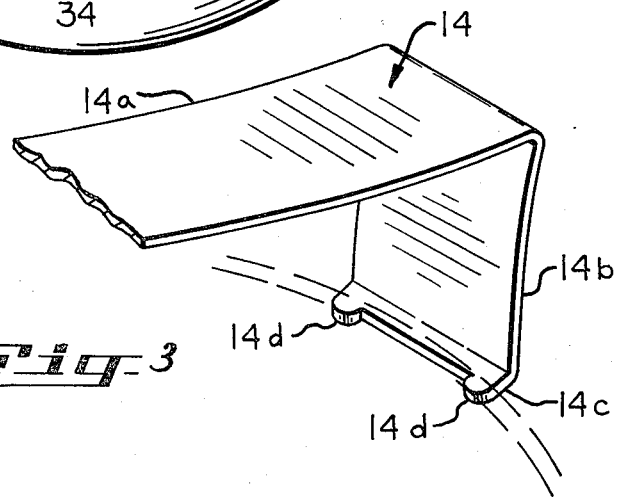
FIG. 3 is a perspective view of one end portion of the spring clip of the sealing system.

As shown in FIG. 3, the inturned tabs 14*c* preferably have inwardly extending rounded projections or fingers 14*d* at their opposite ends for engaging a raised portion of the jar rim. These projections provide two-point rather than single-point contact at the opposite sides of the jar, and therefore inhibit any tendency for the spring clip to slip sideways from the jar. The top band 14*a* extends downwardly in a long gentle arc from its opposite end intersections with arms 14*b*, reaching a low point midway between its opposite ends where the band engages the top of the uppermost boss of the lid while the tabs 14*c* grip the jar rim to exert a downward force on the lid to hold it securely in place on the jar rim.

All three elements of the sealing system described are designed to be reusable. The lid is designed to have the advantage of fitting jar mouths of different sizes so that it can be used not only on jars specifically designed for canning, but also on conventional glass jars such as mayonnaise jars, in which various food products are commonly marketed. For this purpose the lids can be manufactured in varying diameters, although the two bosses of different diameter on a single lid enable such lid to be used with a wide variation of jar mouth sizes.

Another advantage of the sealing system described is that it can be used with jars having any type of threaded rim or no threads at all because its sealing capabilities are not dependent on any threaded connection of the lid assembly with the jar.

METHOD OF USE

In use a jar of any desired size or type is partially filled with the food product to be canned and then with boiling water or other hot liquids nearly to the top of the jar in the conventional manner. Depending on the size of the jar mouth, the side of the lid to extend downwardly against the rim of the jar is selected, and sealing ring 12 is stretched over the boss on that side of the lid so that the broad flat portion of the ring lies along the flange surface of the lid. Then the lid is placed on the upper edge of the rim so that sealing ring 12 engages the rim. Then spring clip 14 is applied to the jar with the tabs gripping either the bead 22 or the threads 24, depending on which is necessary to cause band 14a to press down on the lid to hold the lid on the jar.

As the contents of the jar cool with the lid, sealing ring and spring clip in place, a partial vacuum is created within the upper end of the jar in the small space left after the jar is almost filled with boiling water. This partial vacuum creates an airtight seal between the jar rim and the lid with the help of sealing ring 12 and thus holds the lid on the jar by means of the differential pressure acting on the lid. The partial vacuum also draws the sealing ring 12 inwardly more tightly about the periphery of boss 30, filling notches 36 of such boss with sealing ring material. This filling of the indentations or notches 36 is readily observable because of the transparent or translucent nature of the lid. When so observed it is known that the jar is firmly sealed. At this point spring clip 14 is removed from the jar. The lid still remains firmly in place on the jar. The jar can now be moved to storage until its contents are ready for use. The removed clip can be used immediately in sealing another jar in accordance with the same method.

When its contents are to be removed from the jar, tabs 38 of the sealing ring are gripped and pulled radially outwardly, breaking the seal between the lid and the jar rim. Now the lid can simply be lifted from the jar and its contents removed. After separation and cleansing, the sealing ring and lid are ready for reuse in another canning operation.

Although it is helpful to use the notches 34 and 36 on the bosses of the jar lid, these are not essential in the sealing system described. If the notches are not used, the canner can simply rely through experience on the cooling time required to form an airtight seal between the lid and the jar rim. When the indicator notches are used, however, it has been found that an ideal sealing ring for this purpose is a No. 254 neoprene rubber having a thickness of from 0.1 to 0.085 inches. Such a gasket provides up to 300 percent elongation so that it can be used for many different boss diameters and for regular, small and large-mouth bottles. Also, if the indicator notches are used, the opposite faces of the flange portion 26*c* of the jar lid should be smoothly polished to minimize friction as much as possible.

Having illustrated and described the principles of my invention through what is presently a preferred embodiment thereof, it should be apparent to persons having skill in the art that such embodiment may be modified in arrangement and detail without departing from such principles. It is my intention to claim as my invention all such modifications as come within the true spirit and scope of the following claims.

I claim:

1. In a canning jar sealing system the improvement comprising:

a canning jar lid having a generally disc-shaped rigid main body portion with parallel opposed surfaces, each said opposed surface having an integral raised boss portion positioned centrally thereon and spaced radially inwardly of the outer periphery thereof such that said main body portion defines a peripheral flange for overlying the rim of the mouth of a canning jar with either one of said surfaces supported on said rim and a corresponding one of said boss portions extending inwardly of the jar mouth, the diameter of one of said boss portions being greater than the diameter of the other said boss portions for accommodating jars of different mouth diameters, each said boss portion having a generally circular peripheral edge surface, and a removable thin, flat, resilient elastomeric sealing ring encircling snugly and carried by said peripheral edge surface of one said boss portion and adapted to encircle snugly and to be carried by the other said boss portion when either one of said boss portions is inserted into the jar mouth, said ring having a sufficient width across its flat annulus such that said ring extends between the top edge of the jar rim and the adjacent said flange surface to form an air seal between the jar rim and said flange when said lid covers the tops of different jars having mouths of different diameters, a spring clip comprising a thin, resilient band of spring metal extending across the outside of said lid when said lid is supported on the rim of a jar, said band having downturned opposite end portions defining arms extending downwardly along the outer opposite sides of the jar rim and lid, said downturned arms each having inturned lower ends defining tab portions for gripping the underside of a bead or screw thread on the outer circumference of a jar rim, said band engaging and exerting a downward force against the uppermost surface portion of the outermost boss portion of said lid when the other said boss portion extends into the mouth of a jar and said tab portions grip the jar rim and being adapted to engage and exert a downward force against the other boss portion when the lid is reversed.

2. In a sealing system according to claim 1, the improvement comprising said spring clip band when relaxed extending downwardly in a smooth continuous arc toward the central portion thereof along its length from its opposite end intersections with said downturned arm portions, and said downturned arm portions when relaxed extending inwardly toward each other from said intersections such that the arcuate band portion flexes upwardly and said arm portions flex outwardly to accomodate jar rims of different diameters and of different thread or bead placements.

3. In a sealing system according to claim 1, the improvement comprising each of said tabs having at least two inwardly projecting fingers for engaging the underside of the jar bead or thread, said fingers extending inwardly from opposite ends of said tabs.

4. In a canning jar sealing system the improvement comprising:

a canning jar lid having a generally disc-shaped rigid main body portion with parallel opposed surfaces, each said opposed surface having an integral raised boss portion positioned centrally thereon and spaced radially inwardly of the outer periphery thereof such that said main body portion defines a peripheral flange for overlying the rim of the mouth of a canning jar with either one of said surfaces supported on said rim and a corresponding one of said boss portions extending inwardly of the jar mouth, the diameter of one of said boss portions being greater than the diameter of the other said boss portion for accomodating jars of different mouth diameters, a thin flat, resilient elastic sealing ring encircling snugly one said boss portion and adapted to encircle snugly the other said boss portion when inserted into the jar mouth to form an air seal between the jar rim and said peripheral flange, said jar lid being composed of a light-transmitting material, The peripheral edge surfaces of said boss portions each having at least one indentation therein visible from the outer surface of said lid whereby a portion of said sealing ring enters said indentation of the ring-encircled boss portion within the jar mouth upon creation of a partial vacuum within the jar to visually indicate the sealed condition of the jar.

5. In a sealing system according to claim 4, the improvement comprising:

each said boss portion having a generally circular peripheral edge surface, said sealing ring snugly and carried by said peripheral edge surface of one said boss and adapted to encircle and be carried by the other said boss portion when inserted into the jar mouth, said ring extending along the flange surface adjacent the boss portion carrying said ring to form an air seal between said flange surface and the underlying rim of a jar.

6. In a sealing system according to claim 4, the improvement comprising:

a spring clip comprising a thin, narrow, resilient band of spring metal extending across the outside of said lid when said lid is supported on the rim of a jar, said band having downturned opposite end portions defining arms for extending downwardly along the outer opposite sides of the jar rim and lid, said downturned arms each having inturned lower ends defining tab portions for gripping the underside of a bead or a screw thread on the outer circumference on a jar rim, said band being engageable with and exerting a downward force against the uppermost surface portion of the outermost boss portion of said lid when said tab portions engage the jar rim.

7. In a sealing system according to claim 6, the improvement comprising:

each said boss portion having a generally circular peripheral edge surface, said sealing ring snugly and carried by said peripheral edge surface of one said boss portion and adapted to encircle and be carried by the other said boss portion when inserted into the jar mouth, said ring extending along the flange surface adjacent the boss portion carrying said ring to form an air seal between said flange surface and the underlying rim of a jar.

8. In a sealing system according to claim 4, the improvement comprising said lid being composed of transparent glass.

* * * * *

UNITED STATES PATENT OFFICE

CERTIFICATE OF CORRECTION

PATENT NO. : 3,991,897

DATED : November 16, 1976

INVENTOR(S) : RONALD B. MEYERS

It is certified that error appears in the above-identified patent and that said Letters Patent are hereby corrected as shown below:

Column 6, line 21, claim 5, delete "snugly and";

Column 6, line 48, claim 7, delete "snugly and".

Signed and Sealed this

First Day of February 1977

[SEAL]

*Attest:*

RUTH C. MASON
*Attesting Officer*

C. MARSHALL DANN
*Commissioner of Patents and Trademarks*